US006216391B1

(12) United States Patent
Garrett, Jr.

(10) Patent No.: US 6,216,391 B1
(45) Date of Patent: Apr. 17, 2001

(54) QUICK-RELEASE GRATING INCORPORATING PULLEYS AND CABLES

(76) Inventor: Clarence W. Garrett, Jr., 14 Royal Palm Cir., Port Orange, FL (US) 32127

( * ) Notice: Subject to any disclaimer, the term of this patent is extended or adjusted under 35 U.S.C. 154(b) by 0 days.

(21) Appl. No.: 09/353,940

(22) Filed: Jul. 15, 1999

(51) Int. Cl.[7] ..... E06B 9/02; E05B 65/10

(52) U.S. Cl. ..... 49/141; 49/50; 49/52; 49/53; 49/67

(58) Field of Search ..... 49/141, 50, 52, 49/53, 61, 63, 67, 394, 395, 503; 292/38, 171

(56) References Cited

U.S. PATENT DOCUMENTS

| | | | | |
|---|---|---|---|---|
| 1,615,120 | * | 1/1927 | Fischer | 292/38 |
| 1,652,574 | * | 12/1927 | Mattson | 292/94 |
| 2,660,274 | * | 11/1953 | Donathan | 49/141 |
| 3,910,611 | * | 10/1975 | Slovensky | 292/38 |
| 3,913,957 | | 10/1975 | Astie et al. . | |
| 3,946,460 | * | 3/1976 | Johnson | 16/82 |
| 4,019,281 | * | 4/1977 | Weiler | 49/56 |
| 4,110,867 | * | 9/1978 | Gwozdz | 16/82 |
| 4,127,966 | * | 12/1978 | Schmidt | 49/141 |
| 4,199,176 | * | 4/1980 | Kelly | 292/38 |
| 4,243,090 | | 1/1981 | Kemp . | |
| 4,258,504 | * | 3/1981 | Hicks | 49/56 |
| 4,263,747 | * | 4/1981 | Coltrin et al. | 49/56 |
| 4,476,957 | | 10/1984 | Ory . | |
| 4,653,226 | * | 3/1987 | Woodrow | 49/57 |
| 4,796,384 | * | 1/1989 | Warwick | 49/55 |
| 4,817,334 | | 4/1989 | Badger et al. . | |
| 4,841,673 | * | 6/1989 | Tjomsland | 49/141 |
| 4,856,229 | * | 8/1989 | Tserng | 49/57 |
| 4,897,961 | * | 2/1990 | Shine | 49/141 |
| 4,999,949 | * | 3/1991 | Granlund | 49/383 |
| 5,012,610 | * | 5/1991 | Carballo | 49/57 |
| 5,018,302 | * | 5/1991 | Kluge | 49/56 |
| 5,072,464 | * | 12/1991 | Draheim et al. | 5/93.1 |
| 5,174,063 | * | 12/1992 | Lewis et al. | 49/141 |
| 5,603,183 | | 2/1997 | Giovinazzi . | |
| 5,619,821 | * | 4/1997 | St. George et al. | 49/57 |
| 5,657,578 | | 8/1997 | Thompson . | |
| 5,740,628 | | 4/1998 | Almond . | |

* cited by examiner

*Primary Examiner*—Daniel P. Stodola
*Assistant Examiner*—Gregory J. Strimber
(74) *Attorney, Agent, or Firm*—Paul S. Rooy

(57) ABSTRACT

A quick-release grating comprising an actuator mounted to the grating, a frame to which the grating is rotatably mounted via of grating hinges, and a safety pin which prevents re-closure of the grating once it has been opened. The actuator comprises spring-loaded deadbolts which slide through frame and grating bores in order to lock the grating in position relative to the frame. The actuator is enclosed within a locked box which prevents unauthorized opening of the grating. An alternate embodiment quick release grating provides for an actuator disposed remote to the grating, which has the benefit of obviating the need to enclose the actuator within a locked box. An additional alternate embodiment quick release grating provides for deadbolts mounted to a grating top member and a grating bottom member. An additional alternate embodiment quick release grating incorporates a transwall structure, whereby an externally-mounted grating may be released via an internally-mounted remote actuator.

22 Claims, 7 Drawing Sheets

QUICK-RELEASE GRATING INCORPORATING PULLEYS AND CABLES

BACKGROUND OF THE INVENTION

1. Field of the Invention

This invention relates to gratings, and in particular to a quick-release grating.

2. Background of the Invention

In today's security-conscious world, gratings have become a common architectural feature in residences and commercial buildings alike. The incidence of burglaries, home invasions and thefts which has occurred in this century has contributed to a desire for protection against unwanted building entries. As a result, many windows feature sturdy gratings made of metal bars welded into a frame, which cover a window or other building aperture, and prevent entry by a burglar, who could otherwise gain entrance merely by breaking the window glass.

An unfortunate side effect of the existence of window gratings is their converse ability to prevent building occupants from exiting through the barred window in an emergency, such as a building fire. It is a sad irony that every year individuals are trapped inside burning buildings by the very window gratings which were supposed to protect them.

Thus it has become extremely important to provide a grating quick-release which on the one hand is secure enough to prevent burglaries, yet on the other hand is capable of quick, reliable release. In this fashion, building occupants would be provided an escape route through building apertures equipped with a grating quick-release, and yet when the apertures they cover are not being used as exits, the gratings would prevent unwanted entry by burglars and thieves.

Existing Designs

A number of devices capable of releasing a grating have been proposed. U.S. Pat. Nos. 3,913,957, 4,243,090 and 5,657,578 were granted Astie et al., Kemp, and Thompson respectively. While these devices provided a means of releasing a security grating, it was possible for a burglar to break the window glass and introduce a hand or tool through the grating and open the grating. Needless to say, this design shortcoming defeated the very purpose for installing a security grating in the first place.

U.S. Pat. Nos. 4,476,957 and 5,603,183 were granted Ory and Giovinazzi respectively. These devices combined a ladder function with a security grating, and appear to have been designed for a second floor (or higher) window. Although means to release the grating was taught, the release mechanism in both cases required substantial vertical clearance below the window upon which the grating was mounted. Where such substantial vertical clearance did not exist, it would be difficult or impossible to open the grating in case of fire.

SUMMARY OF THE INVENTION

Accordingly, it is an object of the present invention to provide a quick-release grating which is easily unlocked with a single pull of a handle. Design features allowing this object to be accomplished include an actuator bar attached to deadbolts by means of cable and pulleys. Advantages associated with the accomplishment of this object include the ability to quickly and easily unlock a security grating in case of fire, and then to use the opening it covered to exit the structure.

It is another object of the present invention to provide a quick-release grating which provides a means to keep the opened grating from re-closing. Design features allowing this object to be accomplished include a safety pin disposed within a safety pin housing, and a safety pin spring which is pre-loaded in order to urge the safety pin into an extended position. A benefit associated with the accomplishment of this object is prevention of re-closing of the grating after it has been opened, thus maintaining open an escape route for other building occupants.

It is still another object of this invention to provide a quick-release grating which prevents burglars from accessing the actuator bar from the exterior of the building. Design features enabling the accomplishment of this object include a lockable box door, and an actuator disposed within the box. An advantage associated with the realization of this object is increased security from break-ins.

It is another object of the present invention to provide a quick-release grating which may be remotely activated from an interior location removed from the grating itself. Design features allowing this object to be accomplished include a remote actuator connected to remote deadbolt assemblies by means of cables. A benefit associated with the accomplishment of this object is obviation of the need to enclose the actuator within a locked box, and hence speedier quick-release grating unlocking.

It is still another object of this invention to provide a quick-release grating which may be used to unlock an exterior grating from the inside of a structure to which it is mounted. Design features enabling the accomplishment of this object include a transwall actuator featuring one or more deadbolts exterior to the building, connected to an interior remote actuator by means of cables carried on pulleys. Advantages associated with the realization of this object include the provision of a fire escape route actuatable from the inside of a building even when the grating is mounted external to the building, as well as elimination of the need to enclose the actuator in a locked box, thus providing faster grating unlocking.

BRIEF DESCRIPTION OF THE DRAWINGS

The invention, together with the other objects, features, aspects and advantages thereof will be more clearly understood from the following in conjunction with the accompanying drawings.

Seven sheets of drawings are provided. Sheet one contains FIG. 1. Sheet two contains FIG. 2. Sheet three contains FIG. 3. Sheet four contains FIG. 4. Sheet five contains FIG. 5. Sheet six contains FIG. 6. Sheet seven contains FIG. 7.

DETAILED DESCRIPTION OF THE PREFERRED EMBODIMENT

Figure 1:
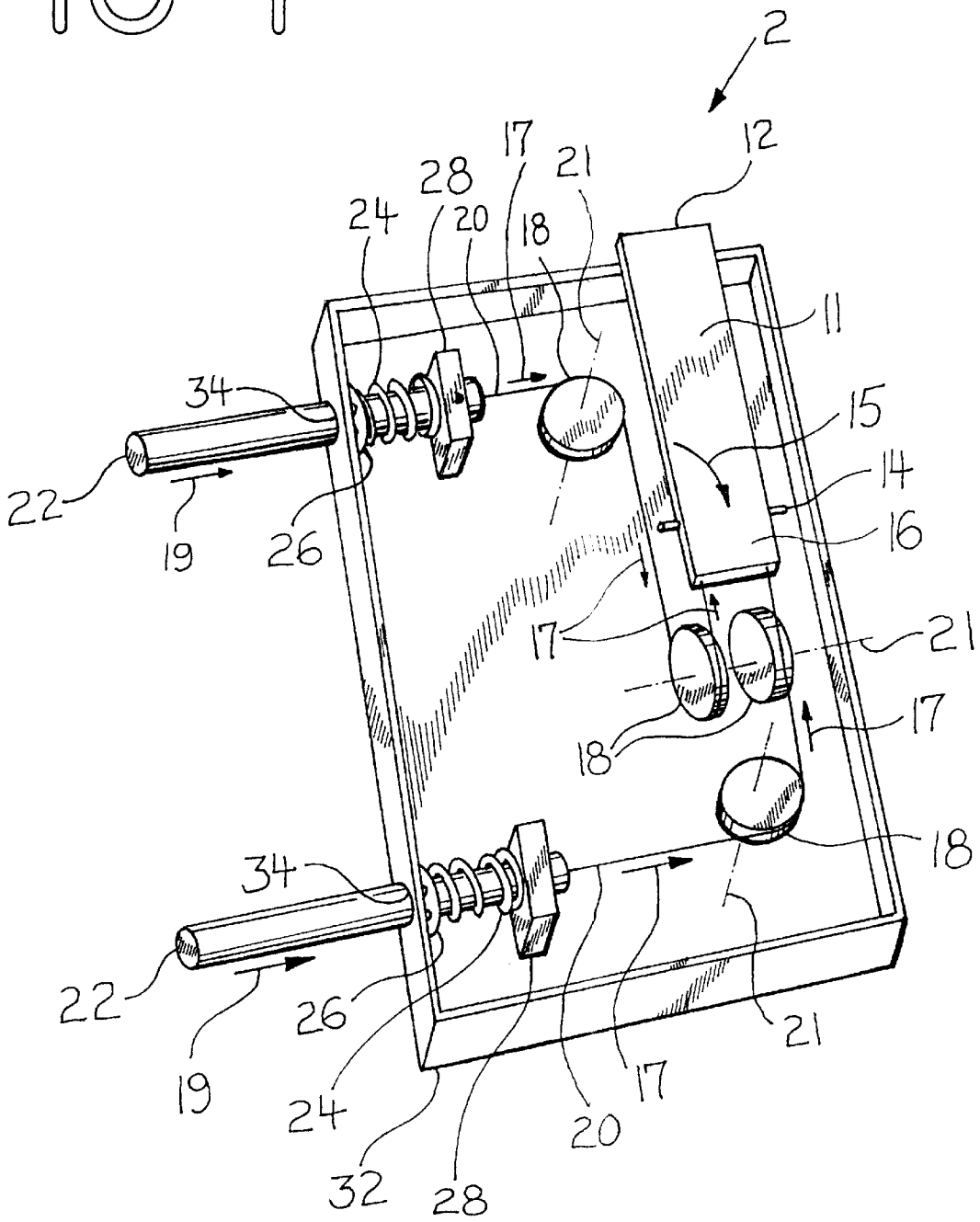
FIG. 1 is a front isometric view of an actuator.
Figure 2:
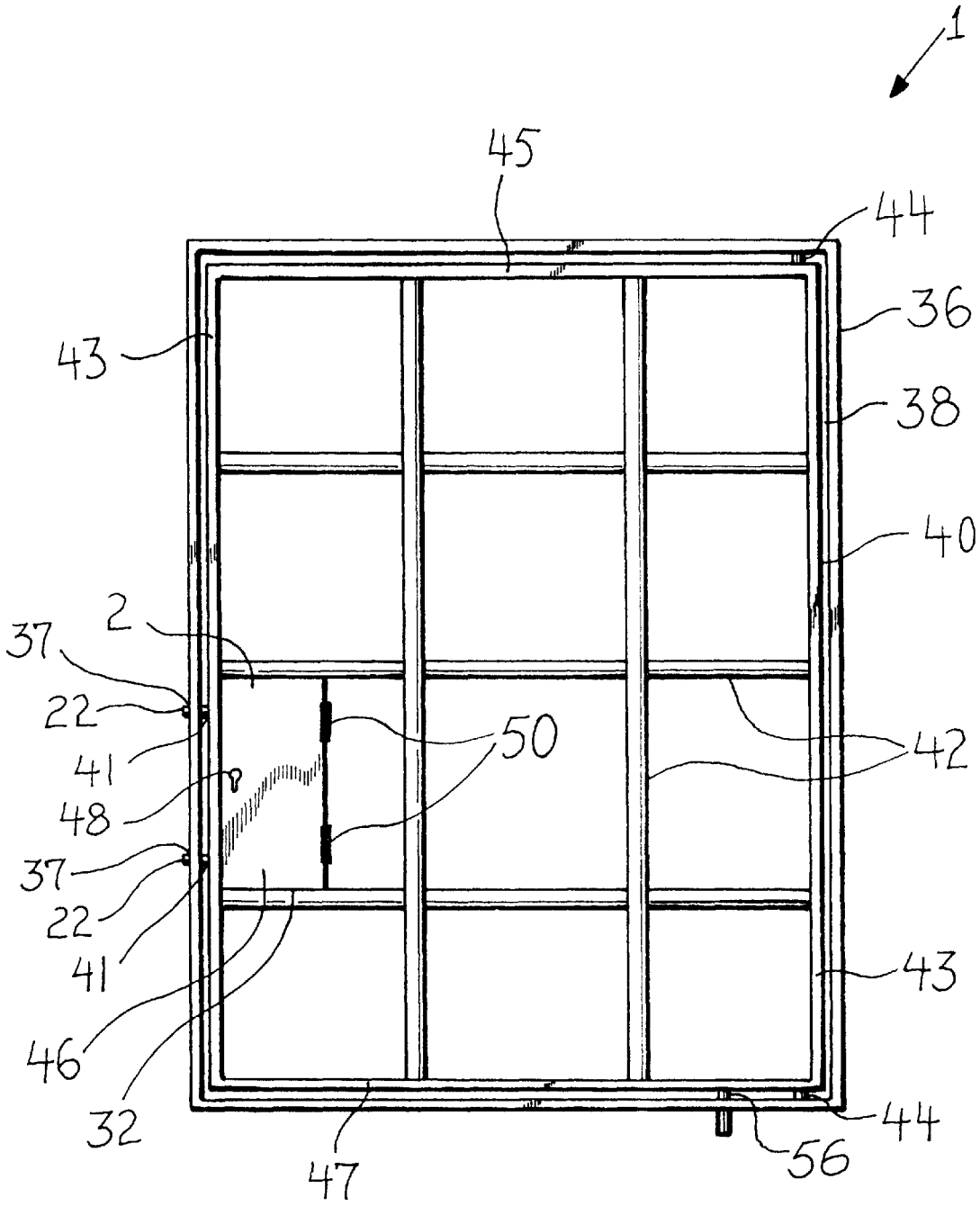
FIG. 2 is a front view of a quick-release grating.
Figure 3:
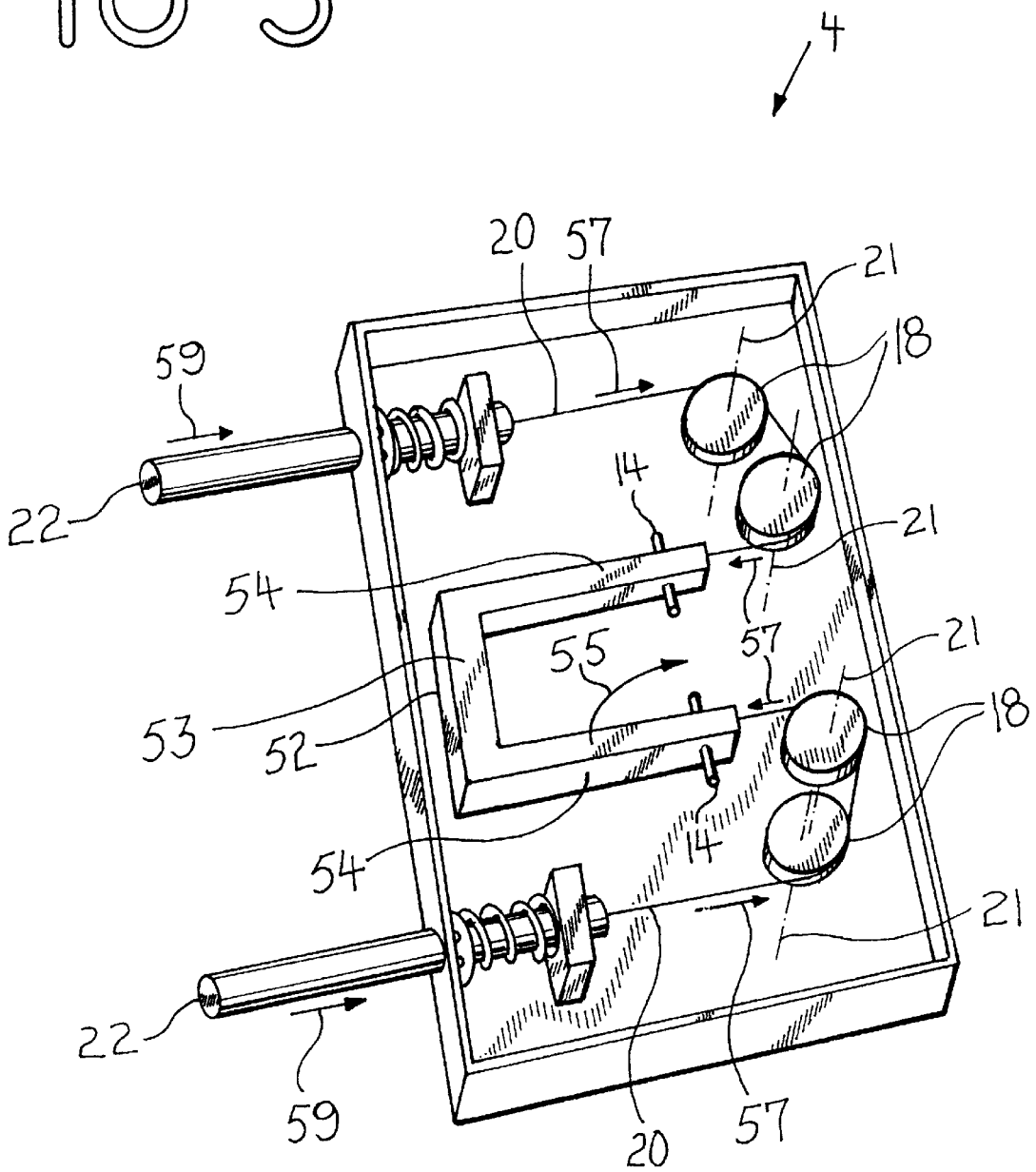
FIG. 3 is a front isometric view of an U-handle actuator.
Figure 4:
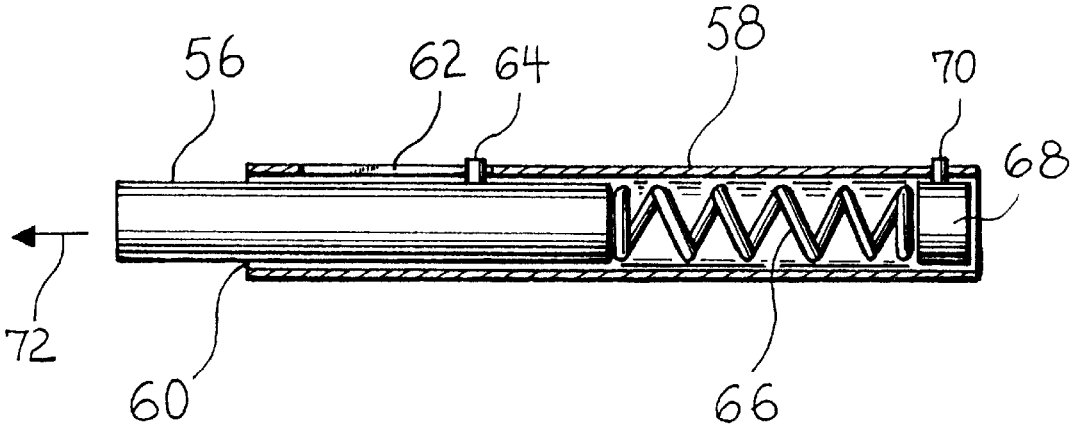
FIG. 4 is a front isometric cross-sectional view of a safety pin.

The instant disclosure teaches a number of embodiments of the instant invention. FIG. 1 is a front isometric view of actuator 2. FIG. 2 depicts same installed on grating 40. FIG. 3 is a front isometric cross-sectional view of an alternate embodiment actuator 2. FIG. 4 is a front isometric cross-sectional view of safety pin 56, which keeps grating 40 from slamming shut and re-locking once it has been opened using the instant quick-release method.

Figure 5:
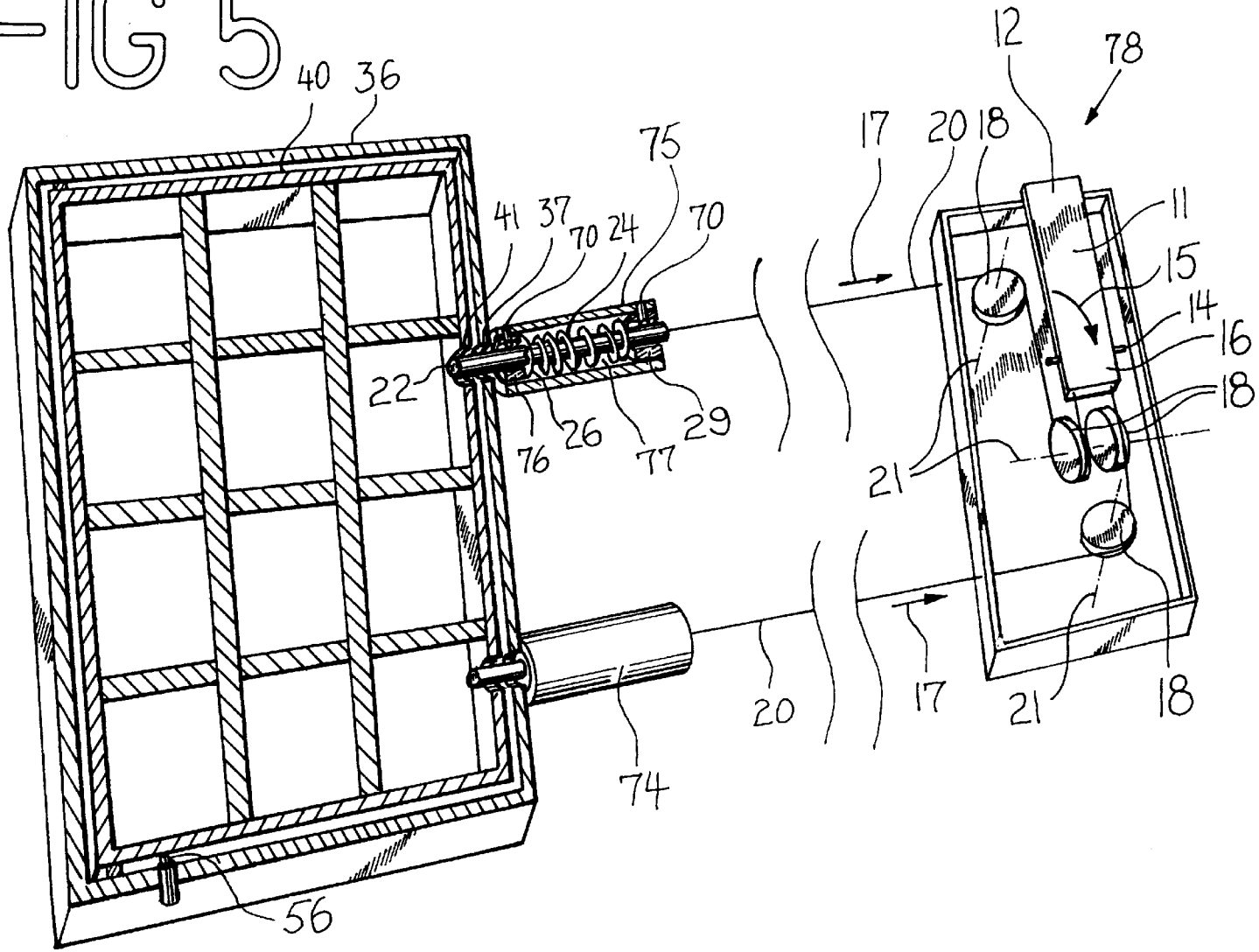
FIG. 5 is a front isometric cross-sectional view of a remote actuator connected to remote deadbolt assemblies by means of cables, and a safety pin.

FIG. 5 is a front isometric cross-sectional view of remote actuator 78 connected to remote deadbolt assemblies 74 by means of cables 20, installed on frame 36 and grating 40, and safety pin 56.

Figure 6:
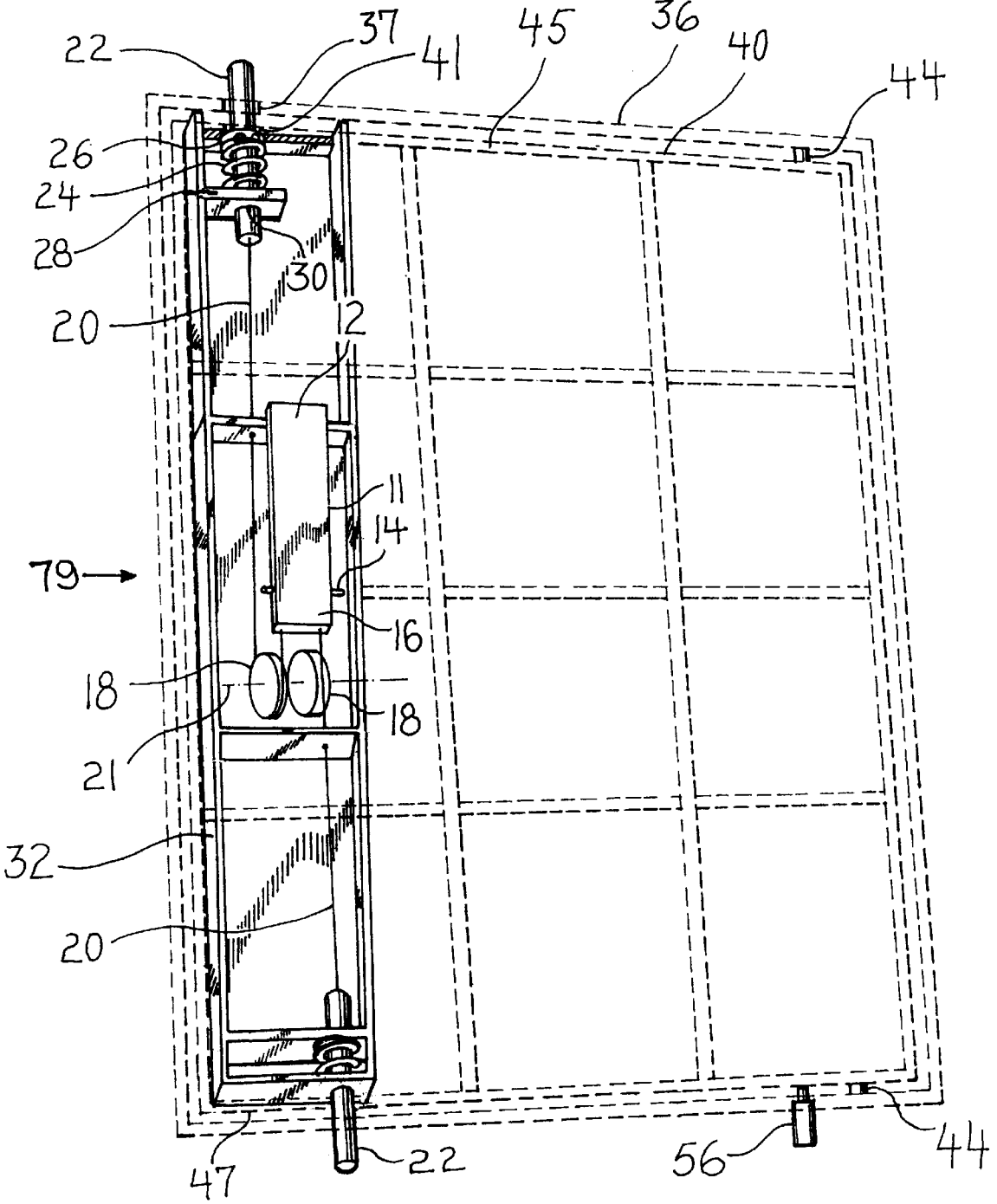
FIG. 6 is a front cross-sectional view of an grating-mounted remote actuator with spring-loaded deadbolts installed on a grating top member and a grating bottom member.
Figure 7:
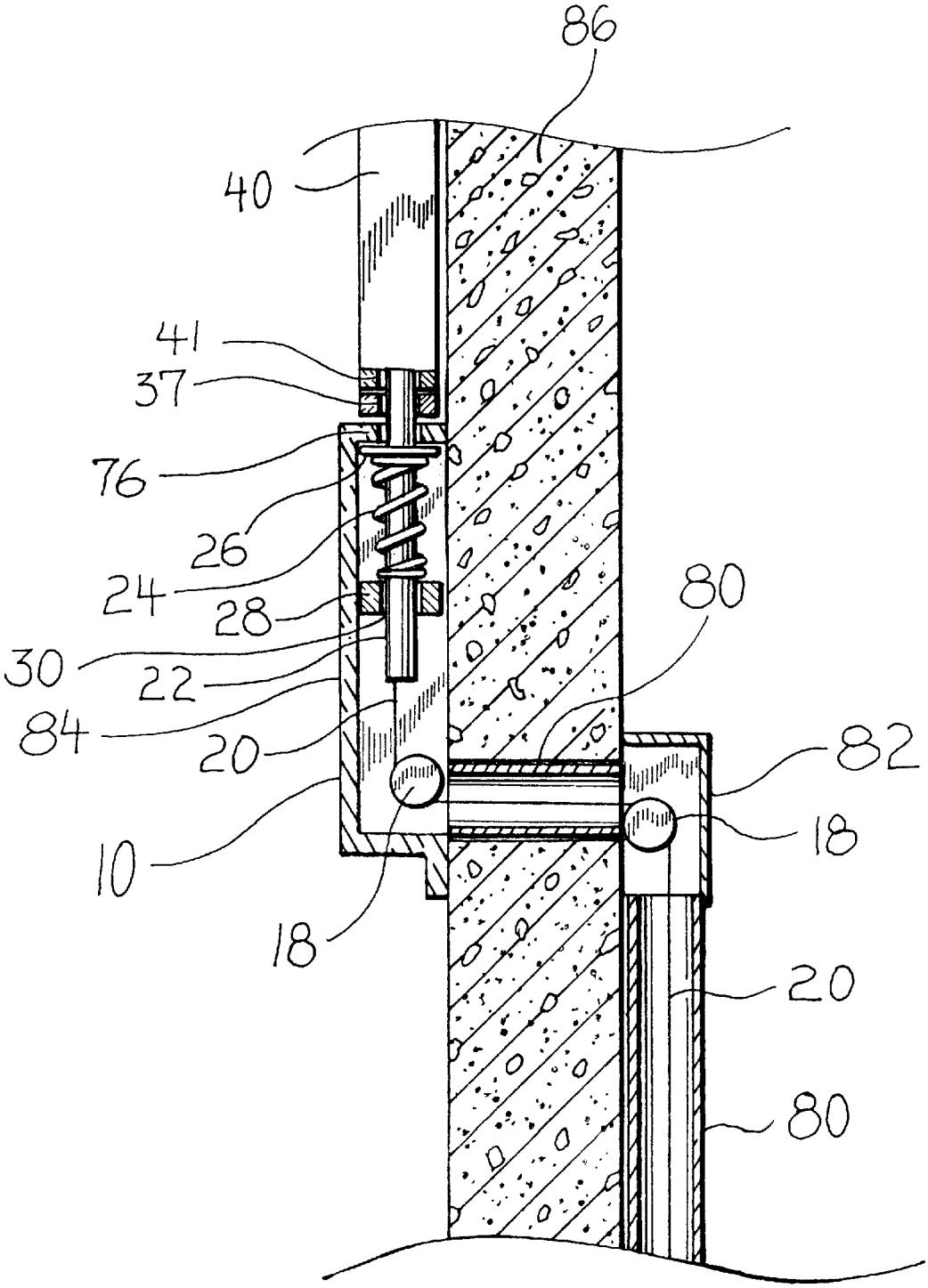
FIG. 7 is a side cross-sectional view of a transwall actuator.

FIG. 6 is a front cross-sectional view of an alternate embodiment remote actuator 78 with spring-loaded deadbolts 22 installed on grating top member 45 and grating bottom member 47. FIG. 7 is a side cross-sectional view of transwall actuator 10, whereby an interior remote actuator 78 may be employed to actuate externally mounted deadbolt (s) 22.

Referring now to FIGS. 1 and 2, we observe actuator 2 mounted in grating 40, which in turn is mounted within frame 36. Frame 36 would be mounted over an existing edifice aperture such as a window, door, etc.

Frame 36 comprises frame aperture 38 sized to admit grating 40. Grating 40 is disposed within frame aperture 38, and is rotatably attached to frame 36 by means of grating hinges 44. When grating 40 is closed, it is disposed substantially co-planar with frame 36. Grating 40 may be opened relative to frame 36 by rotating grating 40 on hinges 44 so that grating 40 opens in the same manner as a conventional vertically-pivoted window.

Grating 40 comprises grating top member 45 rigidly attached to grating bottom member 47 by means of grating side members 43. A matrix of bars 42 are disposed within, and rigidly attached to, grating top member 45, grating bottom member 47, and grating side members 43. Grating bars 42 prevent unwanted entry through the edifice aperture to which frame 36 and grating 40 are attached.

Actuator 2 is mounted on a grating side member 43 opposite grating hinges 44. Actuator 2 comprises actuator bar 11 attached to deadbolts 22 by means of cables 20 carried on pulleys 18. Actuator bar 11 pivots on handle axle 14, and comprises handle 12 on one side of handle axle 14 and lever 16 on the other side of handle axle 14. Cables 20 are attached to an extreme (end) of lever 16 opposite handle 12. The action of pulling on handle 12 has the effect of pivoting actuator bar 11 on handle axle 14 as indicated by arrow 15, which in turn pulls cables 20 as indicated by arrows 17, which causes deadbolts 22 to retract as indicated by arrows 19. As may be observed in FIG. 2, when grating 40 is closed and locked in frame 36, deadbolts 22 extend through grating bores 41 and frame bores 37. When handle 12 is pulled, cables 20 retract deadbolts 22 out of frame bores 37, and permit grating 40 to open. Each cable of actuator 2 rides on two pulleys 18: one pulley 18 whose pulley axis of rotation 21 is parallel to handle axle 14, and one pulley 18 whose pulley axis of rotation 21 is perpendicular to handle axle 14.

Actuator 2 further comprises box 32 having box bores 34, and deadbolt spring stops 28 having deadbolt spring stop bores 30. See also FIG. 6. Box bore 34 and deadbolt spring stop bore 30 are sized to slidably admit deadbolt 22. Deadbolts 22 are spring-loaded in the extended position depicted in FIG. 1 by means of deadbolt springs 24. Deadbolt spring 24 is constrained in a compressed position between deadbolt spring stop 28 and E-clip 26, which is installed on deadbolt 22. E-clip 26 is a standard, off-the-shelf fastener which is made of stiffly resilient material. When a properly sized E-clip 26 is installed on deadbolt 22, it will retain its axial position on deadbolt 22, even under the urging of deadbolt spring 24. Thus, compressed deadbolt spring 24 pushes against deadbolt spring stop 28 and E-clip 26, thereby spring-loading deadbolt 22 into the extended position depicted in FIGS. 1, 3, 5, 6 and 7.

FIG. 2 depicts actuator 2 installed in grating 40. Box 32 comprises box door 46 hingedly attached to box 32 by means of box door hinges 50. Box door 46 also comprises a means of locking box door 46 relative to box 32, in order to prevent unauthorized operation of actuator 2. The embodiment illustrated in FIG. 2 depicts box door lock 48 which is locked and unlocked by means of a conventional key. Other box door lock 48 embodiments contemplated to be within the scope of the instant invention include a keypad type electronic lock, the use of a magnetic card type lock such as is common in hotels and motels, a combination lock, a voice activated lock, a fingerprint reader lock, an eye retinal scanner recognition lock, and any other appropriate locking mechanism.

FIG. 3 depicts U-handle actuator 4 comprising U-handle 52. U-handle 52 comprises U-handle cross bar 53. A U-handle leg 54 is attached to each extreme of U-handle cross bar 53. Each U-handle leg 54 rotates about a handle axle 14. One cable 20 is attached to each U-handle leg 54 at an extreme opposite U-handle cross bar 53. The action of pulling on U-handle cross bar 53 has the effect of pivoting U-handle legs 54 on handle axles 14 as indicated by arrow 55, which in turn pulls cables 20 as indicated by arrows 57, which causes deadbolts 22 to retract as indicated by arrows 59. Each cable 20 of alternate embodiment actuator 2 rides on two pulleys 18 whose pulley axes of rotation 21 are perpendicular to handle axle 14.

As may be observed in FIGS. 2 and 4, safety pin 56 is mounted to frame 36, and is spring-loaded into an extended position, such that when grating 40 is opened, safety pin 56 extends and prevents grating 40 from re-closing. Safety pin 56 is slidably disposed within safety pin housing bore 60 of safety pin housing 58. Safety pin spring 66 is installed in a compressed position within safety pin housing bore 60 between safety pin 56 and safety pin spring stop 68. Safety pin spring stop 68 is immobilized relative to safety pin housing 58 by means of lock pin 70, which extends through safety pin housing 58 into safety pin spring stop 68. Guide pin 64 is rigidly attached to safety pin 56, and extends radially from safety pin 56. Safety pin housing 58 further comprises safety pin housing slot 62, sized to slidably admit guide pin 64. Guide pin 64 reciprocates within safety pin housing slot 62, and limits the movement of safety pin 56 to reciprocation within safety pin housing bore 60.

Safety pin 56 is depicted in FIG. 4 in the retracted position, as it would be constrained by grating 40 when grating 40 is closed. When grating 40 is opened, grating 40 slides off of spring-loaded safety pin 56, permitting safety pin spring 66 to force safety pin 56 into its extended position, as indicated by arrow 72. When extended, safety pin 56 extends into the path of travel of grating 40, thus preventing it from rotating into the closed position.

FIG. 5 is a front isometric cross-sectional view of remote actuator 78 connected to remote deadbolt assemblies 74 by means of cables 20, installed on frame 36 and grating 40, and safety pin 56. A major benefit of this configuration is obviation of the need to enclose remote actuator 78 within a locked box 32, and hence speedier quick-release grating unlocking.

Remote actuator 78 comprises actuator bar 11 which pivots on handle axle 14, and comprises handle 12 on one side of handle axle 14, and lever 16 on the other side of handle axle 14. Cables 20 are attached to an extreme of lever 16 opposite handle 12. The action of pulling on handle 12 has the effect of pivoting actuator bar 11 on handle axle 14 as indicated by arrow 15, which in turn pulls cables 20 as indicated by arrows 17, which causes deadbolts 22 to retract. When grating 40 is closed and locked in frame 36 as depicted in FIG. 5, deadbolts 22 extend through grating bores 41 and frame bores 37. When handle 12 is pulled, cables 20 retract deadbolts 22 out of grating bores 41, and permit grating 40 to open. Each cable of remote actuator 78 rides on two pulleys 18: one whose pulley axis of rotation 21 is parallel to handle axle 14, and one pulley 18 whose pulley axis of rotation 21 is perpendicular to handle axle 14.

Actuator bar 11 is attached to deadbolts 22 by means of cables 20 carried on pulleys 18. Deadbolts 22 comprise part of remote deadbolt assemblies 74. Each remote deadbolt assembly 74 comprises remote deadbolt housing 75 having remote deadbolt housing bore 77 sized to slidably admit deadbolt 22. Deadbolt stop 76 and annular deadbolt spring stop 29 are disposed at opposite extremes of remote deadbolt housing 75. Deadbolt stop 76 is immobilized relative to remote deadbolt housing by means of lock pin 70 extending through remote deadbolt housing 75 into deadbolt stop 76. Annular deadbolt spring stop 29 is immobilized relative to remote deadbolt housing 75 by means of lock pin 70 extending through remote deadbolt housing 75 into annular deadbolt spring stop 29.

Deadbolts 22 are spring-loaded in the extended position depicted in FIG. 5 by means of deadbolt springs 24. Deadbolt spring 24 is constrained in a compressed position between deadbolt spring stop 28 and E-clip 26, which is installed on deadbolt 22. E-clip 26 is a standard, off-the-shelf fastener which is made of stiffly resilient material. When a properly sized E-clip 26 is installed on deadbolt 22, it will retain its axial position on deadbolt 22, even under the urging of deadbolt spring 24. Thus, compressed deadbolt spring 24 pushes against deadbolt spring stop 28 and E-clip 26, thereby spring-loading deadbolt 22 into the extended position.

In operation, handle 12 is pulled, which pulls cables 20, which in turn retract deadbolts 22. Grating 40 may then be opened, and safety pin 56 prevents unwanted re-closing of same.

FIG. 6 is a front cross-sectional view of an grating-mounted remote actuator 79 with spring-loaded deadbolts 22 installed on grating top member 45 and grating bottom member 47.

The grating-mounted remote actuator 79 depicted in FIG. 6 comprises actuator bar 11 which pivots on handle axle 14, and comprises handle 12 on one side of handle axle 14 and lever 16 on the other side of handle axle 14. Cables 20 are attached to an extreme of lever 16 opposite handle 12. As in the previous embodiments, the action of pulling on handle 12 has the effect of pivoting actuator bar 11 on handle axle 14, which in turn pulls cables 20, which causes deadbolts 22 to retract. When grating 40 is closed and locked in frame 36, deadbolts 22 extend through grating bores 41 and frame bores 37. When handle 12 is pulled, cables 20 retract deadbolts 22 out of frame bores 37, and permit grating 40 to open. Each cable of the grating-mounted remote actuator 79 rides on one pulley 18 whose pulley axis of rotation 21 is parallel to handle axle 14.

Actuator bar 11 is attached to deadbolts 22 by means of cables 20 carried on pulleys 18. Deadbolts 22 are spring-loaded in the extended position depicted in FIG. 6 by means of deadbolt springs 24. Deadbolt spring 24 is constrained in a compressed position between deadbolt spring stop 28 and E-clip 26, which is installed on deadbolt 22. The entirety of grating-mounted remote actuator 79 and deadbolt 22 assemblies, except for the protruding extremes of deadbolts 22 which engage frame bores 37, may be locked within box 32 as is depicted in FIG. 6, to prevent unauthorized operation.

In operation, handle 12 is pulled, which pulls cables 20, which in turn retract deadbolts 22. Grating 40 may then be opened, and safety pin 56 prevents unwanted re-closing of same.

FIG. 7 is a side cross-sectional view of transwall actuator 10, whereby an interior remote actuator 78 (not depicted in FIG. 7, but one embodiment thereof is depicted in FIG. 5) may be employed to actuate externally mounted deadbolts 22. Major benefits of the quick-release grating embodiment depicted in FIG. 7 include the provision of a fire escape route actuatable from the inside of a building even when grating 40 is mounted external to the building, as well as elimination of the need to enclose remote actuator 78 in a locked box 32, thus providing faster grating 40 unlocking.

Transwall actuator 10 comprises exterior housing 84 connected to interior housing 82 by means of pipe 80, and another pipe 80 connects interior housing 82 to remote actuator 78. Exterior housing 84 is mounted to the outside of wall 86; interior housing 82 is mounted to the inside of wall 86. Interior housing 82 comprises pulley 18 which carries cable 20. Exterior housing 84 comprises pulley 18 which carries cable 20. Exterior housing 84 further comprises deadbolt 22, which is spring-loaded in the extended position depicted in FIG. 7 by means of deadbolt spring 24. Deadbolt spring 24 is constrained in a compressed position between deadbolt spring stop 28 and E-clip 26, which is installed on deadbolt 22. Deadbolt stop 76 prevents over-extension of deadbolt 22. E-clip 26 is a standard, off-the-shelf fastener which is made of stiffly resilient material. When a properly sized E-clip 26 is installed on deadbolt 22, it will retain its axial position on deadbolt 22, even under the urging of deadbolt spring 24. Thus, compressed deadbolt spring 24 pushes against deadbolt spring stop 28 and E-clip 26, thereby spring-loading deadbolt 22 into the extended position.

In operation, handle 12 in remote actuator 78 is pulled, which pulls cable 20 carried by interior housing pulley 18 and exterior housing pulley 18, which in turn retracts deadbolt 22 out of grating bore 41. Pipes 80 prevent interference and binding in cable 20. Grating 40 may then be opened, and safety pin 56 prevents unwanted re-closing of same. FIG. 7 depicts a single transwall actuator 10 (which would work well by itself); in the preferred embodiment a pair of transwall actuators 10 was used, so as to provide actuation for two deadbolts 22.

In the preferred embodiment, most components of quick-release grating were made of metal, plastic, synthetic, or other appropriate material. E-clip 26, safety pin spring 66 and deadbolt spring 24 were standard, off-the-shelf components. Cable 20 was steel cable, nylon, synthetic, or other appropriate material, and pipe 80 was PVC pipe, galvanized or aluminum pipe, or other appropriate material.

It is important to note that while most quick-release grating embodiments disclosed herein teach two deadbolts 22, any number of deadbolts 22 (along with their associated cable 20 carried by pulleys 18, and remote deadbolt assemblies 74 if appropriate) may be employed, from a quantity of one on upwards, depending on the size and configuration of grating 40 to be locked. Deadbolts 22 may or may not extend completely through frame bore 37. In addition, although FIG. 5 depicts lock pins 70 constraining deadbolt spring 24 and E-clip 26 within remote deadbolt housing bore 77, it is contemplated that the instant invention embrace any appropriate method known within the art of so doing.

While a preferred embodiment of the invention has been illustrated herein, it is to be understood that changes and variations may be made by those skilled in the art without departing from the spirit of the appending claims.

Drawing Item Index

1 quick-release grating
2 actuator
4 U-handle actuator
10 transwall actuator
11 actuator bar
12 handle
14 handle axle
15 arrow
16 lever
17 arrow
18 pulley
19 arrow
20 cable
21 pulley axis of rotation
22 deadbolt
24 deadbolt spring
26 E-clip
28 deadbolt spring stop
29 annular deadbolt spring stop
30 deadbolt spring stop bore
32 box
34 box bore
36 frame
37 frame bore
38 frame aperture
40 grating
41 grating bore
42 bar
43 grating side member
44 grating hinge
45 grating top member
46 box door
47 grating bottom member
48 box door lock
50 box door hinge
52 U-handle
53 U-handle cross ban
54 U-handle leg
55 arrow
56 safety pin
57 arrow
58 safety pin housing
59 arrow
60 safety pin housing bore
62 safety pin housing slot
64 guide pin
66 safety pin spring
68 safety pin spring stop
70 lock pin
72 arrow
74 remote deadbolt assembly
75 remote deadbolt housing
76 deadbolt stop
77 remote deadbolt housing bore
78 remote actuator
79 grating-mounted remote actuator
80 pipe
82 interior housing
84 exterior housing
86 wall

I claim:

1. A quick-release grating comprising:

a frame comprising at least one frame bore and a frame aperture;

a grating rotatably attached to said frame by grating hinges, said grating being sized to fit into said frame aperture, said grating comprising at least one grating bore, each said at least one grating bore being co-extensive with each said at least one frame bore when said grating is in a closed position; and an actuator comprising an actuator bar pivotable about a handle axle, said actuator bar being attached to at least one deadbolt by at least one a cable carried by at least two pulleys, one said pulley having an axis of rotation parallel to said handle axle, the other said pulley having an axis of rotation perpendicular to said handle axle, each said at least one deadbolt extending through a corresponding one of said at least one grating bore and a corresponding one of said at least one frame bore when said grating is in said closed position to lock said grating to said frame.

2. The quick-release grating of claim 1 wherein said grating further comprises a grating side member on a side of said grating opposite said grating hinges, said grating side member including said at least one grating bore therein, said actuator being mounted on said grating side member.

3. The quick-release grating of claim 2 wherein each said deadbolt is spring biased into an extended position.

4. The quick-release grating of claim 3 wherein each said deadbolt is spring biased into said extended position by an E-clip attached to said deadbolt, a deadbolt spring stop within which said deadbolt is free to reciprocate, and a deadbolt spring installed in a compressed state between said deadbolt spring stop and said E-clip.

5. The quick-release grating of claim 4 wherein said actuator bar comprising a handle on one side of said handle axle and a lever on another side of said handle axle, each said at least one cable being attached to an end of said lever opposite said handle.

6. The quick-release grating of claim 2 wherein said actuator is enclosed within a box, said box comprising a box door and a means to lock said box door, whereby unauthorized unlocking of said quick-release grating is prevented.

7. The quick-release grating of claim 6 wherein said means to lock said box door comprises a keyed lock.

8. The quick-release grating of claim 6 wherein said means to lock said box door comprises an electronic key pad.

9. The quick-release grating of claim 1 further comprising a safety pin mounted on said frame, said safety pin being spring-biased into an extended position, said safety pin pressing against said grating when said grating is in said closed position, said safety pin extending into said extended position when said grating is in an open position, thereby preventing said quick-release grating from unintentionally moving from said open position to said closed position.

10. The quick-release grating of claim 9 wherein said safety pin is spring-biased into said extended position by a safety pin housing having a safety pin housing bore sized to slidably admit said safety pin, a safety pin spring stop at one end of said safety pin housing, a guide pin rigidly attached to said safety pin, a safety pin slot in said safety pin housing, said safety pin slot being sized to slidably admit said guide pin, said guide pin being slidable within said safety pin slot, and a safety pin spring installed in a compressed state within said safety pin housing between said safety pin and said safety pin spring stop.

11. The quick-release grating of claim 1 further comprising an exterior housing communicating with an interior housing through a pipe, a pulley in said exterior housing, a pulley in said interior housing, said deadbolt being disposed in said exterior housing and being spring-biased into an extended position, and said actuator being installed in a location removed from said grating.

12. The quick-release grating of claim 11 wherein said deadbolt is spring-biased into said extended position by of an E-clip attached to said deadbolt, a deadbolt spring stop, and a deadbolt spring between said E-clip and said deadbolt spring stop.

13. The quick-release grating of claim 12 wherein said actuator communicates with said interior housing through a pipe, said cable being disposed within said pipes.

14. The quick-release grating of claim 1 wherein said at least one frame bore comprises two frame bores and said grating comprises a grating side member on a side of said grating opposite said grating hinges, said at least one grating bore comprising two grating bores disposed in said grating side member, each said grating bore being co-extensive with a respective one of said frame bores when said grating is in said closed position; and said actuator is mounted on said grating side member.

15. The quick-release grating of claim 14 wherein each said deadbolt is spring-biased into an extended position by an E-clip attached to said deadbolt, a deadbolt spring stop within which said deadbolt is free to reciprocate, and a deadbolt spring installed in a compressed state between said deadbolt spring stop and said E-clip.

16. The quick-release grating of claim 15 wherein said actuator bar comprises a handle on one side of said handle axle and a lever on another side of said handle axle, each said cable being attached to an end of said lever opposite said handle.

17. The quick-release grating of claim 16 wherein said actuator is enclosed within a box, said box comprising a box door and a means to lock said box door, whereby unauthorized unlocking of said quick-release grating is prevented.

18. A quick-release grating comprising:

a frame comprising at least one frame bore and a frame aperture;

a grating rotatably attached to said frame by grating hinges, said grating being sized to fit into said frame aperture, said grating comprising at least one grating bore, each said at least one grating bore being co-extensive with each said at least one frame bore when said grating is in a closed position;

at least one remote deadbolt assembly mounted on said frame, each said remote deadbolt assembly comprising a deadbolt spring-biased into an extended position, each said deadbolt extending through a corresponding one of said at least one frame bore and a corresponding one of said at least one grating bore when said grating is in said closed position to lock said grating to said frame; and a remote actuator comprising an actuator bar pivotable about a handle axle, and means for attaching said actuator bar to said at least one remote deadbolt assembly carried by at least two pulleys, one said pulley having an axis of rotation parallel to said handle axle, the other said pulley having an axis of rotation perpendicular to said handle axle, said remote actuator being installed in a location removed from said grating.

19. The quick-release grating of claim 18 wherein, said actuator bar comprises a handle on one side of said handle axle and a lever on another side of said handle axle, said means for attaching said actuator bar to said at least one remote deadbolt assembly, being attached to an end of said lever opposite said handle.

20. A quick-release grating comprising:

a frame comprising at least one frame bore and a frame aperture;

a grating rotatably attached to said frame by grating hinges, said grating being sized to fit into said frame aperture, said grating comprising at least one grating bore, each said at least one grating bore being co-extensive with each said at least one frame bore when said grating is in a closed position;

at least one remote deadbolt assembly mounted on said frame, each said remote deadbolt assembly comprising a deadbolt spring-biased into an extended position, each said deadbolt extending through a corresponding one of said at least one frame bore and a corresponding one of said at least one grating bore when said grating is in said closed position to lock said grating to said frame; and a remote actuator comprising an actuator bar attached to at least one said deadbolt by at least one cable, said remote actuator being installed in a location removed from said grating, said actuator bar pivotable about a handle axle, said actuator bar comprising a handle on one side of said handle axle and a lever on another side of said handle axle, each said at least one cable being attached to an end of said lever opposite said handle, each said cable being carried on two pulleys, one said pulley having an axis of rotation parallel to said handle axle, the other said pulley having an axis of rotation perpendicular said handle axle.

21. The quick-release grating of claim 20 wherein said deadbolt is spring-biased into said extended position by an E-clip attached to said deadbolt, a deadbolt stop and a deadbolt spring stop disposed at opposite end of a remote deadbolt housing bore in a remote deadbolt housing, and a deadbolt spring installed in a compressed state within said remote deadbolt housing bore between said deadbolt stop and said deadbolt spring stop.

22. The quick-release grating of claim 21 further comprising a safety pin mounted on said frame, said safety pin being spring-biased into an extended position, said safety pin pressing against said grating when said grating is in said closed position, said safety pin extending into said extended position when said grating is in an open position, thereby preventing said quick-release grating from unintentionally moving from said open position to said closed position.

* * * * *